US005791651A

United States Patent [19]

Bryant

[11] Patent Number: 5,791,651

[45] Date of Patent: Aug. 11, 1998

[54] THREE DICE BOARD GAME

[76] Inventor: Richard S. Bryant, 827 Ester St., Cahokia, Ill. 62206

[21] Appl. No.: 827,218

[22] Filed: Mar. 28, 1997

[51] Int. Cl.[6] ..... A63F 3/00

[52] U.S. Cl. ..... 273/274; 273/146

[58] Field of Search ..... 273/146, 274, 273/309, 268

[56] References Cited

U.S. PATENT DOCUMENTS

| | | | |
|---|---|---|---|
| 1,492,737 | 5/1924 | Meyer | 273/146 |
| 3,608,906 | 9/1971 | Odier | 273/146 X |
| 4,312,508 | 1/1982 | Wood | 273/146 X |
| 4,346,900 | 8/1982 | Lanlee | 273/274 |
| 4,688,803 | 8/1987 | Ollington | 273/274 |
| 4,746,126 | 5/1988 | Angileri | 273/274 X |
| 5,282,633 | 2/1994 | Boylan et al. | 273/274 X |
| 5,308,081 | 5/1994 | Bartle | 273/274 |
| 5,413,351 | 5/1995 | Franklin | 273/309 X |
| 5,620,183 | 4/1997 | Skratulia | 273/274 X |

*Primary Examiner*—William E. Stoll
*Attorney, Agent, or Firm*—Robbins & Robbins

[57] ABSTRACT

A casino type board game is provided in which chips may be purchased from the house. Three dice are employed which may be hexagonal and have an equal number of sides bearing the same indicia of one to three. The board is arranged with an area for wagering on triples of pre-selected identical one, two or three indicia. The central area is flanked by one or two side sections for wagering on Pass, Don't Pass and Any Triples. Additional proposition bets such as Straights, HI-LO and the like may be provided as desired. Winning wagers are paid by the house while losing wagers are collected.

22 Claims, 2 Drawing Sheets

THREE DICE BOARD GAME

BACKGROUND OF THE INVENTION

Various types of dice games have been used in the past. Probably the most widely known is the game employing a pair of hexagonal dice with indicia of one to six on the sides.

Such a game is commonly employed on a table in which a dealer handles the betting with chips being placed in designated areas on the table depending upon whether the bettor wishes to bet on or against the shooter of the dice with different areas for different combinations.

Various combinations are thrown with the general object for the thrower of the dice to win by rolling a "natural" on the come out roll comprising the sum of the pips on the pair of dice being seven or eleven. Should he roll a craps, i.e. two, or twelve, the shooter loses. On other combinations, he establishes a "point" which he must throw again to win. He loses by throwing a seven. The odds vary depending on the combination rolled.

While such games employing hexagonal dice with indicia of one to six have been popular, there has remained a desire and need for a new game using the familiar dice or other dice but with new features and combinations to provide new challenges for the players.

SUMMARY OF THE INVENTION

The dice board game of this invention is a casino type dice game that may be played on a board or a craps table equipped with a special layout. Dealers may be positioned as they are for craps. The game utilizes three six-sided dice with indicia one through three arranged twice on the faces of the cube so that opposite faces have the same indicia. Other dice structures may also be used that have an equal number of faces with indicia of one to three.

Chips may be purchased from the house. Wagers may be made by the shooter and the other players against the house. Both single and multiple roll propositions may be selected. The wagers may be selected from Triples, Straights, Any Triples, Come, Don't Come, Pass, Don't Pass, Doubles, Even, Odd, Totals, Place Bets and others.

The game of this invention provides a novel dice game which can provide an edge for the house and uses six-sided dice much like the conventional craps game where the dice have indicia of one to six. However, by using three six-sided special dice having paired sides of one to three indicia, a new game has been created that is simpler and can be enjoyed by a wider range of gamblers. The game has some familiar features including six-sided dice, a shooter, players and a house, so that the game will be easily learned by new shooters and players, while adding the feature of different indicia and a new game board structure for wagering on new types of rolls.

The above features are objects of this invention. Further objects will appear in the detailed description which follows and will be otherwise apparent to those skilled in the art.

For the purpose of illustration of this invention two embodiments with an advantage for the house ranging from about 1 to 12 percent are shown and described hereinbelow and in the accompanying drawing. It is to be understood that this is for the purpose of example only and that the invention is not limited thereto.

IN THE DRAWING

DESCRIPTION OF THE INVENTION

Figure 1:
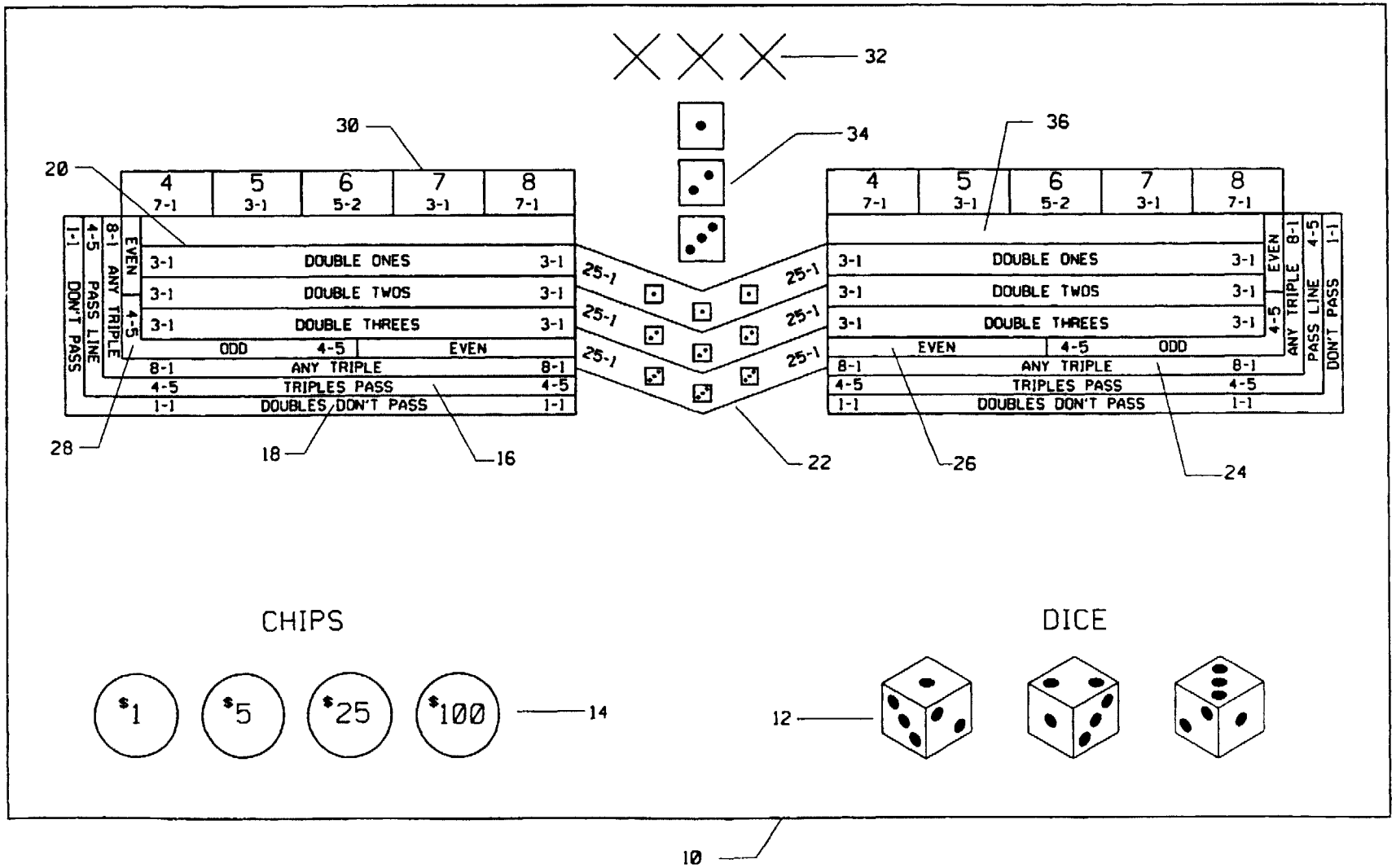
FIG. 1 is a plan view of one embodiment of the dice board game.

The dice board of this invention is generally indicated by the reference numeral 10 in FIG. 1. It is played with three six-sided dice 12, each one having indicia from one to three on opposite sides of the dice. The indicia may be in the form of numerals 1, 2 and 3 or one, two and three pips or the like. While the six-sided cube dice 12 are preferred, it will be understood that variations of such dice may be employed. Thus, barrel dice having a hexagonal cross section providing six faces or sides and dodecahedron dice having 12 sides may be employed or other constructions having a multiple of six faces. The indicia of one, two and three, may be on opposite faces or side by side.

Betting is done with chips 14 which may be in various denominations, such as for example, $1, $5, $25 and $100. Wagers may be made by the shooter and by a number of players against the house. Both single and multiple roll propositions may be selected. Dealers may be positioned as in a casino type dice game using a pair of the conventional six-sided dice with indicia from one to six.

The board is provided with a multiplicity of sections to provide for a variety of wagers with varying odds. These sections are a Pass line 16, a Don't Pass line 18, a Doubles section 20, a Triples section 22, an Any Triples section 24, an Even section 26, an Odd section 28 and a Totals section 30. X-shaped markers 32 are provided for use by the dealer in the doubles thrown section 34.

The Pass line 16 is arranged as an L-shaped section on the inside of the outer L-shaped Don't Pass section 18. Inside the Pass Line 16 is the L-shaped Any Triple section 24. An inner tiered Doubles section 20 is arranged for doubles of dice having one, two or three indicia showing on top.

A layered V-shaped Triples section 22 is arranged in the center of the board for pre-selected triples having one, two or three indicia with the dice showing in each of three tiers whether the triples are one, two or three indicia. The L-shaped section 24 inside the pass section 16 is for any Triples which are not pre-selected.

Even and odd sections 26 and 28 respectively, are arranged in staggered relation in an L-shaped configuration between the Any Triple section 24 and the Doubles section 20.

The Totals section 30 overlies a blank area 36 above the Doubles section 20 and provides areas for wagering on various totals of the thrown dice.

Markers 32 are provided for the boxperson to indicate doubles that have been thrown. The markers are placed in area 34 as shooters try to make passes.

In the layout sections, the Triples section 22 is positioned between the Pass section 16, the Don't Pass section 18, the Even and Odd sections 26 and 28, the Doubles section 20 the Any Triple section 24, and the Totals section 30, which are arranged in duplicate at the sides of the Triples section. This provides for a greater number of players and ease in handling of the wagers by the dealers and stick person.

The wagering is done by placing wagers in the form of one or more chips 14 in one or more of the various sections. Each of the sections is provided with a description of the type of wager and the odds. Where no odds are provided the proposition pays 1 to 1. Each of the sections and odds will be more fully described hereinbelow.

Figure 2:
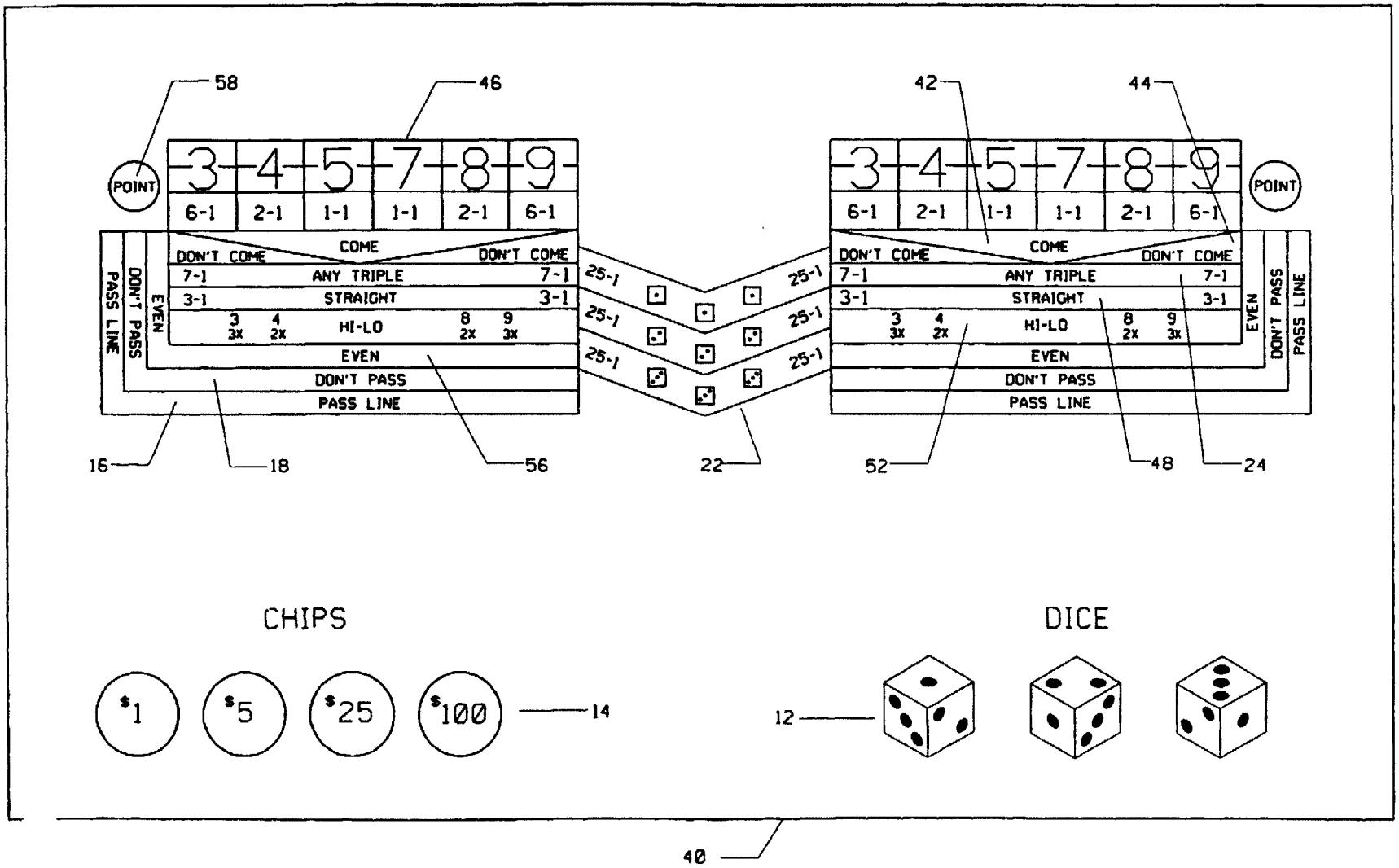
FIG. 2 is a plan view of a second embodiment of the game.

A second embodiment of the game is shown in FIG. 2. The dice board is generally indicated by the reference numeral 40 and is played with the same three dice 12 and chips 14 of the dice board game 10 of FIG. 1. The layout of the board incorporates the same selected Triples section 22.

At the side of the selected Triples section 22 are L-shaped Pass Line 16 and Don't Pass Line 18. Inside the Pass and Don't Pass Lines are Come section 42, Don't Come section 44 and Place Bet section 46 having interior areas numbered 3, 4, 5, 7, 8 and 9. The aforementioned sections constitute multiple roll propositions.

Single roll propositions are also positioned inside the L-shaped Pass and Don't Pass Lines. They are defined by a Straight section 48, a HI-LO section 52, an Even section 56, an Any Triples section 24 and the Triples section 22. In addition, a Point chip 58 is provided to be placed on the Place section 46 after the point has been established.

DESCRIPTION OF THE WAGERS AND USE

BOARD GAME 10

In the Pass line 16, the object of the game is for the shooter to make passes by rolling three of a kind before rolling double ones, double twos, and double threes. The Doubles may come in any order but all three different possibilities must be rolled before pass line wagers lose. Winning pass line wagers are paid 4 to 5. When the shooter fails to make a pass, the dice rotate clockwise to the next shooter. The shooter must wager on either the Pass line or the Don't Pass line.

In the Don't Pass line 18, the player wins even money if the shooter rolls double ones, double twos, and double threes before rolling three of a kind. The boxperson uses markers 32 placed in the doubles thrown area 34 to indicate doubles rolled until a decision is reached.

In the Any Triple section 24 the player receives 8 to 1 if any three of a kind is rolled. Since this wager is paid at fair odds (no advantage for the house) a player must have an equal or greater wager already placed on the Pass or Don't Pass Line. The purpose of the Any Triple section 24 is to allow the player to reduce the house's advantage on the Pass and Don't Pass lines by combining that wager with one paid at fair odds.

In the Doubles section 20, the player may wager that only two of the three dice will show a specific number on a particular roll either ones, twos, or threes. Each of the three doubles wagers pays 3 to 1.

In the Triple section 22, the player may wager that a specific three of a kind will be rolled. Each of the three Triples wagers pay 25 to 1. All bets regarding triples are made with the assistance of the stick person.

In the Even section 26, the player wins 1 to 1 if the sum of the three dice is an even number.

In the Odd section 28, the player wins 4 to 5 if the sum of the three dice is an odd number.

In the Totals section 30, the player may wager on the exact total of the three dice. The payoffs on the possibilities 4 through 8 vary as follows:

| | |
|---|---|
| 4 | 7 to 1 |
| 5 | 3 to 1 |
| 6 | 5 to 2 |
| 7 | 3 to 1 |
| 8 | 7 to 1 |

All bets on Totals are positioned by the dealer. When requesting Totals bets the player places chips to be wagered in the blank area 36 in front of the numbers.

Players desiring to wager on a total of 3 or 9 should refer to the triples section.

Wagers of one Dollar or more are acceptable on all propositions except the Pass line and Odd. For them, two Dollars is the minimum wager. Payoffs are rounded down to the nearest Dollar.

A summary of house advantage, is as follows:

| | |
|---|---|
| Pass Line | 2.28% |
| Don't Pass Line | 8.57 |
| Doubles: | |
| ones | 11.11 |
| twos | 11.11 |
| threes | 11.11 |
| Triples: | |
| ones | 3.80 |
| twos | 3.80 |
| threes | 3.80 |
| Any Triples | 0 |

A wager on any triples must be accompanied by a greater or equal wager on either the Pass or the Don't Pass Line.

| | |
|---|---|
| Even | 3.70 |
| odd | 6.67 |
| Totals: | |
| 4 | 11.11 |
| 5 | 11.11 |
| 6 | 9.24 |
| 7 | 11.11 |
| 8 | 11.11 |

BOARD GAME 40

For the board game 40 as in board game 10, the first roll of the dice after each decision on the Pass 16 or Don't Pass 18 is the come out roll. The player wins if a straight (a one, two, and three) is rolled on the come out. The player loses if Triples (three of a kind) are rolled on the come out. If neither are rolled on the come out, the total becomes the shooter's point. The player makes a pass and wins even money if he/she rolls the point again before rolling a six.

In the Don't Pass Line 18 the player wins if Triples are rolled on the come out except three twos. Three twos are barred and the bet is a push (no winner). The player loses if a straight is rolled on the come out. The player may also win if the shooter fails to make his/her point. The Don't Pass line 18 pays even money.

The Come bet 42 is exactly like the Pass line 16 except this wager is placed after the come out roll. If the player does not roll a straight or Triples the total becomes the Come point.

For the Don't Come 44, this proposition works like the Don't Pass 42 except the bet is placed after the come out roll.

A player with a wager on the Pass 16 or Don't Pass line 18 has the option to take or lay odds on whether or not the point will be made before a six is rolled (except three twos). Three twos are also barred in this situation so that odds wagers can easily be paid at fair odds (there is no edge for the house on odds wagers). The payoffs when taking odds depend on the point as follows:

| | |
|---|---|
| 4 | 2 to 1 |
| 5 | 1 to 1 |
| 7 | 1 to 1 |
| 8 | 2 to 1 |

When laying odds the payoffs are the reciprocal:

| | |
|---|---|
| 4 | 1 to 2 |
| 5 | 1 to 1 |
| 7 | 1 to 1 |
| 8 | 1 to 2 |

Betting areas are not defined on the layout for taking or laying odds. As in craps, these wagers are placed behind the line (blank area between the Pass line 16 and the player).

Place bets in section 46 are similar to odds wagers except the player isn't required to have a line wager and the twos are not barred. The player wins if the place number is rolled before a six and loses when any six is rolled. The payoffs vary as follows:

| | |
|---|---|
| 3 | 6 to 1 |
| 4 | 2 to 1 |
| 5 | 1 to 1 |
| 7 | 1 to 1 |
| 8 | 2 to 1 |
| 9 | 6 to 1 |

In single roll propositions the player wins 3 to 1 if a Straight of one, two, and three is rolled in section 48.

The player wins 1 to 1 if the sum total of the three dice is an Even number for section 56.

For the HI-LO section 52, the player wins 2 to 1 if a 4 or 8 is rolled and 3 to 1 if a 3 or 9 is rolled. The player loses on 5, 6, or 7.

For the Any Triples section 24, the player wins 7 to 1 if any three of a kind is rolled.

For the Triples section 22, the player may wager that a specific three of a kind is rolled. This may be either ones, twos, or threes. Each of the three Triples wagers pays 25 to 1.

| Summary of House Advantage | |
|---|---|
| Pass Line | 1.20% |
| Don't Pass Line | 2.60 |
| Come | 1.20 |
| Don't Come | 2.60 |
| Odds | 0 |
| Place Bets: | |
| 3 | 12.50 |
| 4 | 10.00 |
| 5 | 7.69 |
| 7 | 7.69 |
| 8 | 10.00 |
| 9 | 12.50 |
| Straight | 11.11 |
| Even | 3.70 |
| HI-LO | 3.57 |
| Any Triples | 11.11 |
| Triples: | |
| ones | 3.80 |
| twos | 3.80 |
| threes | 3.80 |

In addition to the above betting sections, other propositions could include odd, singles, doubles, and the like.

Various changes and modifications may be made within this invention as will be apparent to those skilled in the art. Thus, the three indicia may be consecutive or sequential and not necessarily one to three, but four, five and six or the like. Also, the dice may have different numbers of the indicia such that one or more of the dice have the sequential indicia arranged in different fashions from the others. Such changes and modifications are within the scope and teaching of this invention as defined in the claims appended hereto.

What is claimed is:

1. A dice game comprising three dice and a game board, each of the dice having all sides bearing one of three of the same indicia, said game board having selected areas for placing bet on propositions for different combinations rolled and chips for positioning on said areas for placing said bets.

2. The dice game of claim 1 in which said game board has a first defined betting area indicating selected triples and, means on said area indicating a winning outcome and an opposed laterally extending betting area on an opposite side of said first defined betting area having a plurality of defined betting areas for placing bets, means on said opposed rectangular area indicating a winning outcome for said bets.

3. The dice game of claim 1 in which said selected areas include a multiplicity of sub-divided areas for selected triples.

4. The dice game of claim 1 in which said selected areas include a defined area for selected doubles.

5. The dice game of claim 1 in which said selected areas include a defined area for separate odd and even rolls.

6. The dice game of claim 1 in which said selected areas include a defined area for doubles don't pass and a further defined area for triples pass.

7. The dice game of claim 1 which said selected areas include a further defined totals area with sub-divided areas for selected totals.

8. The dice game of claim 7 in which the sub-divided areas are for totals of four, five, six, seven and eight.

9. The dice game of claim 1 in which the selected areas comprise a first defined betting area indicating selected triples and, means on said area indicating a winning outcome and an opposed laterally extending rectangular betting area on an opposite side of said first defined betting area having a plurality of defined betting areas for placing bets, means on said opposed rectangular area indicating a winning outcome for said bets, said side area being duplicated by a second opposed side area substantially identical with said first named side area.

10. The dice game of claim 1 in which the selected areas include a multiplicity of sub-divided areas for selected triples, a defined rectangular area for selected doubles, a defined area for separate odd and even rolls, a defined area for doubles don't pass and a further defined area for triples pass, a defined area for any triple, and a further defined totals area with sub-divided areas for selected totals.

11. The dice game of claim 10 in which the sub-divided areas are for totals of four, five, six, seven and eight.

12. The dice game of claim 1 in which a doubles thrown area is provided with a means for indicating which doubles have been thrown before a decision on pass or don't pass is reached.

13. The dice game of claim 12 in which characterized markers are provided as chips for the doubles thrown area.

14. The dice game of claim 1 in which one of said selected areas has a defined area for any triple.

15. The dice game of claim 14 in which said opposed side area has separate defined areas for each of any triples, HI-LO, Place Bets, a straight for dice bearing the indicia of one, two and three and come and don't come.

16. The dice game of claim 1 in which said selected areas include a defined area for each of pass and don't pass.

17. The dice game of claim 16 in which one of said selected areas has a defined area for any triples.

18. The dice game of claim 1 in which one of said selected areas include a defined area for a straight for dice bearing the indicia of one, two and three.

19. The dice game of claim 1 in which said opposed area has a defined area for Place Bets sub-divided for wagering on 3, 4, 5, 7, 8, and 9.

20. The dice game of claim 1 in which said opposed area has a defined HI-LO area where the player wins on 3, 4, 8 and 9 and loses on 5, 6, or 7.

21. The dice game of claim 1 in which each of said dice have an equal number of sides bearing the same indicia.

22. The dice game of claim 21 in which said dice are hexagonal and have on opposite sides bearing the indicia of one to three and the totals rolled vary from three to nine.

* * * * *